United States Patent [19]

Krautsack

[11] 4,016,977

[45] Apr. 12, 1977

[54] ASSEMBLAGE WITH DUAL SUPPORT

[75] Inventor: Richard G. Krautsack, Arlington Heights, Ill.

[73] Assignee: The Cooperative Marketing Co., Elk Grove Village, Ill.

[22] Filed: Dec. 15, 1975

[21] Appl. No.: 640,556

Related U.S. Application Data

[63] Continuation-in-part of Ser. No. 559,167, March 17, 1975, Pat. No. 3,945,559.

[52] U.S. Cl. ..... 206/526; 40/11 R; 40/23 A; 206/806; 206/813; 248/205 A; 248/467; 248/221.4

[51] Int. Cl.[2] ..... B65D 85/00; G09F 1/00

[58] Field of Search ..... 206/526, 806, 460, 813; 40/23 A, 11 R, 125 R; 248/467, 459, 314, 324, 223, 205 A

[56] References Cited

UNITED STATES PATENTS

| | | | |
|---|---|---|---|
| 2,647,711 | 8/1953 | Margulis | 248/467 |
| 2,755,576 | 7/1956 | Golden | 206/806 |
| 3,290,809 | 12/1966 | King | 206/813 |

*Primary Examiner*—William T. Dixson, Jr.
*Attorney, Agent, or Firm*—Fitch, Even, Tabin & Luedeka

[57] ABSTRACT

An assemblage of sheetlike items for presentation for taking on a one-by-one basis, plus means for supporting it either from a price channel or against a wall. A flat support plate of flexible material includes a head section having a pair of ears formed therein and a base section. The lower edges of the ears are spaced from the upper edge a distance greater than the vertical dimension of a price channel so the ears snap over-center thereinto. The rear surface of the base section carries pressure-sensitive adhesive and a release liner. A pivot links the sheetlike items at a central location on the plate in vertical alignment with the region between the ears. When the head section is uppermost, the ears can be snapped into a price channel to support the items in depending relation therebelow. Rotating the plate so the base section is uppermost permits it to be attached by the adhesive to a vertical surface to stably support the depending items.

4 Claims, 3 Drawing Figures

ASSEMBLAGE WITH DUAL SUPPORT

RELATED APPLICATION

This application is a continuation-in-part of United States patent application Ser. No. 559,167, filed Mar. 17, 1975 now U.S. Pat. No. 3,945,559.

BACKGROUND OF THE INVENTION

This invention relates to supports for dispensing sheet-like items, and more particularly to improvements in such supports which facilitate mounting of such an assemblage in different manners.

It has become increasingly common in the United States for drugstores, grocery supermarkets and retail shops of this general type to display advertising material and the like at locations of convenience and/or of high traffic flow for the purpose of catching the eye of the customer. Prior U.S. Pat. No. 3,881,649, issued May 6, 1975, and my pending patent application Ser. No. 559,167, filed Mar. 17, 1975, which will issue as U.S. Pat. No. 3,945,559, on March 23, 1976, disclose holders for dispensing sheet-like items utilizing a foldable support which is provided with pressure-sensitive adhesive and which is designed to permit the attachment of such an assemblage of items to variously oriented surfaces. Although the arrangements disclosed in these patents have proved to be commercially successful, improvements in devices of this sort are always being sought.

SUMMARY OF THE INVENTION

This invention provides an improved arrangement for supporting an assemblage of sheet-like items for mounting in different orientations so as to present the items for taking on a one-by-one basis. More particularly, a simple support arrangement is provided which is pivotally attached and which can be rotated between one position where it will support the assemblage from a price channel and a second position where it will stably mount to a forward-facing vertical surface, such as a wall.

DETAILED DESCRIPTION OF THE PREFERRED EMBODIMENT

Figure 1:
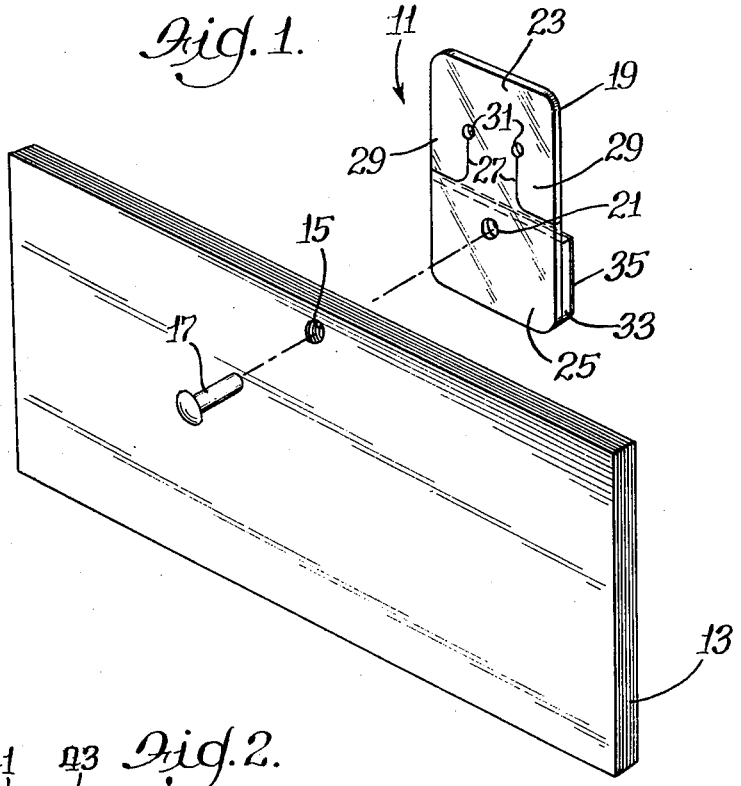
FIG. 1 is an exploded front perspective view showing an assemblage embodying various features of the invention.

The invention provides support means 11 for mounting a plurality of items or sheets 13 which is relatively simple in construction and which has proved to be extremely effective in actual operation. The assemblage of items will usually be for distribution, e.g. order blanks, advertising, recipes, etc., but could be for any other appropriate use, and the sheetlike items may be single sheets, folded sheets or even thin booklets. In the illustrated embodiment, single sheets are used, each of which is provided with an aligned hole 15 near the upper edge thereof and horizontally centered through which a pin or rivet 17 having an enlarged head can be inserted. Accordingly, the sheets 13 are designed to be pulled off, one by one, of the pin 17 by slightly tearing the sheet above the hole 15. If tearing the individual items is undesirable, as for example if thin booklets are being distributed, then an open-top holder can be used to link the sheets to the support means, as shown in the aforementioned U.S. patent, and the pin 17 is simply attached to the rear wall of the holder.

The support means includes a flat plate 19, usually formed of a flexible plastic material, which plate has a generally centrally located hole 21 which receives the end of the hollow rivet 17. The rivet 17 is then treated to prevent its subsequent separation from the plate 19, as by preferably flanging its free end or alternatively by inserting a stud having an enlarged head into the rivet. The plate 19, as best shown in FIG. 1, is formed with a head section 23 and a base section 25; however, the respective position of these two sections can be reversed by rotating the plate 180° about the pin 17 which serves as a pivot point.

The head section 23 has a pair of generally L-shaped cuts 27 which define therein a pair of ears 29. The lower ends of each of these cuts 27 extend outward to the respective lateral edge of the plate 19, whereas each cut terminates at its upper end in a small hole 31 which is effective in preventing undesired elongation of the cut in the flexible plate. The vertical dimension of the ears 29 between the upper edge of the plate and the lower edges of the cuts 27 is greater than the vertical distance between the top and bottom flanges of a price channel. As can be seen in FIG. 1, the support hole 21 is located on the vertical centerline of the plate 19, spaced substantially equidistant from the two L-shaped cuts 27.

The base section 25 of the plate has a thin foam pad 33 affixed to its rear surface which carries a layer of pressure-sensitive adhesive that is covered by a release liner 35. The foam pad 33 is of sufficient thickness that the flanged end of the rivet 17 lies forward of its rear surface, thus shielding it from contact with the surface to which the assemblage is to be mounted. The foam is preferably a soft, tough material, such as polyurethane foam, which is also a good carrier of pressure-sensitive adhesive.

Figure 2:
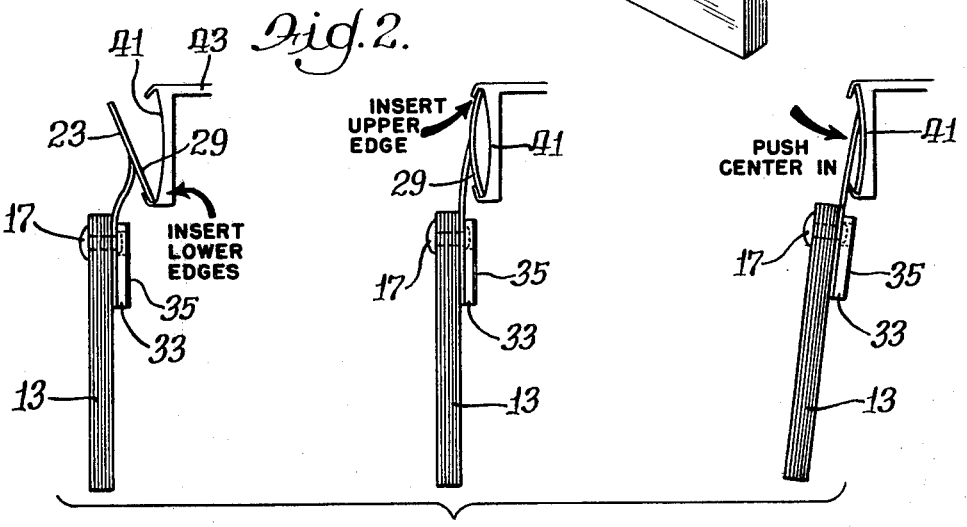
FIG. 2 is a group of three views showing the mounting of the assemblage illustrated in FIG. 1 in a price channel.

FIG. 2 illustrates the mounting of the overall plate-sheet assemblage to a price channel 41 that forms the depending front portion of a supermarket shelf 43. In this disposition, the lower straight edges of the ears 29 formed by the L-shaped cuts 27 lie substantially horizontal and are first inserted into the bottom of the price channel 41, as shown in the left-hand view. The plate 19 is made of a flexible material, such as polyethylene or polyvinyl chloride, for example, and the ears 29 are flexed slightly to permit the insertion of the flat straight upper edge of the head section 23 of the plate past the top flange of the price channel, as depicted in the center view of FIG. 2.

Pressure is then exerted centrally against the head section 23, generally between the two small holes 31, to cause the ears 29 to snap over-center and assume the configuration as shown in the right-hand view of FIG. 2, where the ears 29 conform to the arcuate shape of the rear surface of the price channel 41. In this configuration, the head section 23 of the plate 19 is secured to the price channel 41 and resists any inadvertent jarring that might otherwise dislodge it. The over-center movement of the ears 29, coupled with the flexible nature thereof, causes the straight upper edge and lower edges of the ears to exert slight pressure against the interior curved portions of the top and bottom of the price channel 41. As a result, the arrangement resists dislodgement without first snapping the ears 29 back over-center to the orientation shown in the center view of FIG. 2. Because this return requires a positive action with regard to both ears, it can be appreciated that there is a very secure mating of the plate 19 to the price channel 41 in the support orientation depicted in the right-hand view of FIG. 2.

Figure 3:
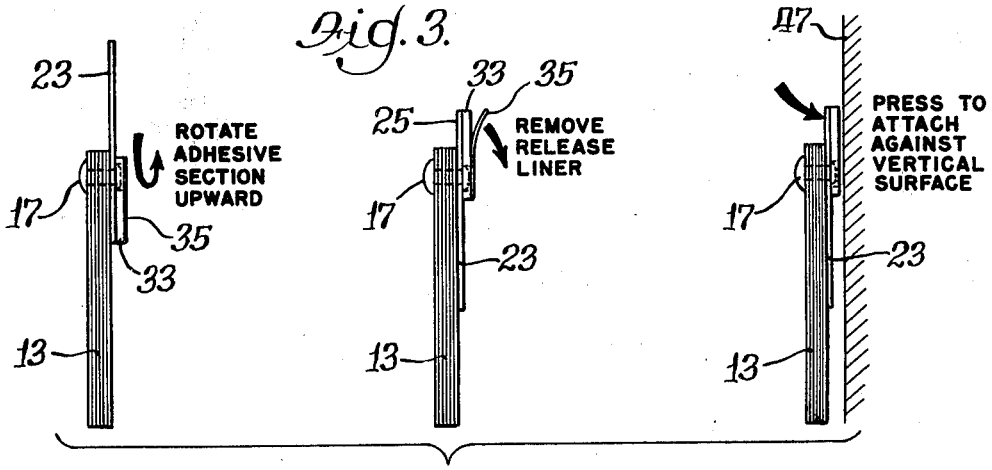
FIG. 3 is a group of three views showing the mounting of the assemblage of FIG. 1 against a vertical surface.

The left-hand view of FIG. 3 depicts the assemblage in the orientation in which it was shown in FIGS. 1 and 2, with the head section 23 uppermost. Accordingly, it is indicated in this view that the plate 19 should be rotated 180° about the pivot pin 17 so that the base section 25 is disposed uppermost and the head section 23 is essentially hidden from view.

Once rotation is completed and the plate 19 is oriented as depicted in the center view of FIG. 3, the release liner 35 is removed to expose the pressure-sensitive adhesive which is carried on the foam pad 33. The adhesive-carrying base section 25 of the plate is then pressed against a wall or other vertical surface 47, as depicted in the right-hand view. Because the major portion of the adhesive-carrying foam pad 33 lies at a vertical level above the pivot pin 17, a very stable support for the group of sheets 13 is effected.

Although the invention has been described with respect to a preferred embodiment, various modifications and changes as would be obvious to one having the ordinary skill in the art may be made without departing from the scope of the invention which is defined solely by the appended claims. For example, although there is no need to interconnect the plurality of sheets 13 by means other than the passage of the pin 17 through the aligned holes 15, a slightly neater appearance may be provided by applying a suitable padding adhesive to the upper edges of the sheets. Various features of the invention are set forth in the claims which follow.

What is claimed is:

1. An assemblage of items for presentation for taking on a one-by-one basis, which assemblage comprises a plurality of generally sheetlike items, means for supporting said items either from a price channel having top and bottom flanges or against the vertical surface of a wall or the like, said support means including a flat support plate of flexible plastic material which includes a head section and a base section, said head section of said plate having a pair of ears formed therein, the lower edges of which ears are spaced from the upper edge of said head section a distance greater than the vertical distance between the top and bottom flanges of a price channel, said plate having pressure-sensitive adhesive means on the rear surface of said base section and having a release liner covering said adhesive, and pivot means linking said plurality of items and said plate, said pivot means being connected to a generally central location on said plate that is vertically aligned with the plate region lying between said ears, so that said plate can be pivoted 180° in the vertical plane of the flat plate from a first orientation, where said head section is uppermost and where after insertion of said upper edge of said head section into the top flange of a price channel said ears can be snapped into the bottom flange of the price channel to cause said ears to first take an outwardly arcuate configuration and after inward application of pressure to snap over-center to lock said ears within the channel and resist dislodgement to securely support said items in depending relation therebelow, to a second upsidedown orientation where said base section is uppermost and said adhesive can attach said plate to a vertical surface and can stably support said items in depending relation generally therebelow.

2. An assemblage in accordance with claim 1 wherein each of said items has a hole located near the upper edge thereof and wherein said pivot means comprises pin means residing in said holes and having an enlarged head at the front end thereof.

3. An assemblage in accordance with claim 2 wherein a foam pad is affixed to the rear surface of the base section of said plate in the region where said pivot pin means resides so that said foam pad shields the rear end of said pivot pin means, said pressure-sensitive adhesive being carried by the rear surface of said foam pad.

4. An assemblage in accordance with claim 1 wherein said ears are formed by a pair of L-shaped cuts in said flexible plastic plate, which cuts each begin at a lateral edge of said plate and respectively terminate in a small hole.

* * * * *